United States Patent [19]

O'Connell et al.

[11] Patent Number: 4,854,146

[45] Date of Patent: Aug. 8, 1989

[54] SECURITY DEVICE AND METHOD

[75] Inventors: John O'Connell, West Midland; Roy S. Jefferies; Hugh Trevor-Jones, both of Bridgnorth, all of United Kingdom

[73] Assignee: Lowe and Fletcher Limited, West Midlands, England

[21] Appl. No.: 75,748

[22] PCT Filed: May 8, 1986

[86] PCT No.: PCT/GB86/00247

§ 371 Date: Jul. 31, 1987

§ 102(e) Date: Jul. 31, 1987

[87] PCT Pub. No.: WO87/02735

PCT Pub. Date: May 7, 1987

[51] Int. Cl.[4] ..... E05B 47/00

[52] U.S. Cl. ..... 70/277; 70/278; 70/493

[58] Field of Search ..... 70/277, 278, 279–283, 70/364 A

[56] References Cited

U.S. PATENT DOCUMENTS

| | | | |
|---|---|---|---|
| 3,499,302 | 3/1970 | Spain | 70/364 A |
| 3,670,538 | 6/1972 | Curry | 70/277 |
| 3,889,501 | 6/1975 | Fort | 70/283 |
| 4,068,507 | 1/1978 | Peterson | 70/271 |
| 4,177,657 | 12/1979 | Aydin | 70/278 |
| 4,603,564 | 8/1986 | Kleinhany | 70/277 |

*Primary Examiner*—Robert L. Wolfe

*Attorney, Agent, or Firm*—Marshall, O'Toole, Gerstein, Murray & Bicknell

[57] ABSTRACT

Relative movement of members (10,11) of a lock is normally obstructed by an element (14) which can be moved by a solenoid (18) entirely into a recess in one of the members so that the one (11) and the obstructing element (14) can turn together relative to the other member (10) and solenoid. The arrangement may be used to prevent turning of a key-receiving member relative to a housing or as a clutch between two members mounted rotatably in a housing.

22 Claims, 8 Drawing Sheets

SECURITY DEVICE AND METHOD

From one aspect, the present invention relates to a security device comprising two relatively movable members, relative movement of which is required to be restrained at certain times and to be permitted at other times. A mechanical lock is an example of such a security device, the lock comprising a housing which is normally stationary and a key-receiving member which, in the absence of the proper key, is restrained against movement relative to the housing, but which can be freed for rotation relative to the housing by application of the proper key.

Several proposals for electronic locks have been published. An example of such a publication is GB 2,158,867A. This published application discloses an electronic cylinder lock and an electronic key and proposes that the cylinder lock be used to operate a mortice lock comprising a spring-loaded bolt and a cam for withdrawing the bolt. The cylinder of the electronic cylinder lock is to be provided with a shaft of square section which engages in a square hole in the cam. Turning of the cam is normally obstructed by a lever and a solenoid is provided for moving the lever out of the path of the cam.

It is proposed in the aforesaid published specification that the key should either have magnetic stripes representing data which identifies the key or should have a semi-conductor memory and an LED, by means of which data stored in the memory can be transmitted to the lock, when the key is applied to the lock. The lock disclosed in the published application has a light-sensitive switch to receive data transmitted from the key and a logic device which verifies whether or not the data from the key is appropriate to authorise operation of the cylinder lock by the key. If the data from the key is interpreted as correct, the logic device provides a signal to energise the solenoid. Reference is made to operation of the solenoid to remove or insert a clutch, as an alternative to the lever. A further alternative which is mentioned is incorporation of the solenoid in the cylinder lock, so that a standard mechanical cylinder could be replaced by a single unit comprising the lock cylinder and the solenoid. However, no examples of arrangements which embody these concepts are described. Clearly, the solenoid and lever illustrated in the drawings of the aforesaid published specification are too bulky to be incorporated in a cylindrical unit having a size similar to that of a standard mechanical cylinder lock such as is commonly provided in a rim latch on a door.

In order to adopt the concept of incorporating the solenoid in a cylinder lock which has the same size as a standard mechanical cylinder, it is necessary to restrict severely the size of the solenoid and associated parts. It will be understood that this requirement conflicts with the requirement for a robust arrangement which will not only prevent forcible turning of the lock cylinder without use of the proper key but which will also avoid any attempt at forcibly turning the lock cylinder resulting in severe damage to the cylinder lock, so that subsequent releasing of the lock by means of the proper key is prevented. The aforesaid published application fails to propose any solution to the conflict between these requirements.

According to a first aspect of the present invention, there is provided a security device comprising two relatively movable members, relative movement of which is required to be restrained, and control means for selectively obstructing relative movement of said members, characterised in that the control means comprises an electrically energisable device having an output element which is moved when the device is energised and an obstructing element movable between an obstructing position in which the obstructing element obstructs said relative movement of said members and a releasing position in which the obstructing element does not so obstruct relative movement of said members and wherein the obstructing element is arranged to be moved by the output element in at least one direction between its obstructing and releasing positions and is not integral with the output element.

By the provision of an obstructing element having the function of obstructing relative movement of said members, but which is not integral with the output element of the electrically energisable device, there can be achieved a robust structure with an electrically energisable device of small size and having a small power consumption. In the event of an attempt being made forcibly to cause relative movement of said members with the obstructing element in the obstructing position, transmission of force from the obstructing element to the output element can be avoided and impairment of the electrically energisable device can thereby be avoided, so that the device will operate normally when subsequently energised.

The secure condition of the security device may be a condition in which said relative movement is restricted or prevented. Alternatively, the secure condition may be a condition in which the relative movement is permitted.

In the obstructing position, the obstructing element may lie partly in one of said members and partly in the other member. In the releasing position, the obstructing element lies outside at least one of said members and may lie entirely in the other of said members or may lie outside both of said members and may lie entirely in a further member.

Both the electrically energisable device and the obstructing element may be mounted in one of said members, so that when the obstructing element is in the releasing position, the other of said members can move relative to the one member, to the electrically energisable device and relative to the obstructing element. Alternatively, the electrically energisable device may be in one of said members and the obstructing element, when in its releasing position, in the other of said members so that one, but not both, of the electrically energisable device and obstructing element participates in movement of a movable one of said members relative to the other of said members.

The electrically energisable device may be an electromagnetic device having an armature which constitutes said output element and which is subjected to magnetic force when the device is energised. The obstructing element is preferably formed of substantially non-magnetic material.

The security device may be a lock, one of said members being a hollow housing and the other of said members being a key-receiving member mounted in the hollow housing for movement relative thereto, the control means comprising signalling means responsive to insertion of the proper key into the key-receiving member to provide a release signal which brings about energisation of the electrically energisable device. An example of such a lock is disclosed in U.K. patent application 8526395, from which the present application claims priority.

Alternatively, a device in accordance with the first aspect of the invention may be a lock comprising a housing in which said relatively movable members are disposed, said members being arranged for rotation about a common axis relative to the housing, one of the members being adapted to receive and to be rotated by a key and the other of the members being adapted to drive a bolt or other associated device. With this arrangement, drive can be transmitted from the key-receiving member to the other of said members when the obstructing element is in the obstructing position. When the obstructing element is in the releasing position, the lock may be in a secure condition, in which the key-receiving member is freely rotatable but drive cannot be transmitted to the other of the members.

In a further example of a device in accordance with the first aspect of the invention, one of said two members may be a bolt and the other member a housing for the bolt. Furthermore, the device may be a keeper for a bolt, the device being adapted to respond to an electrical signal by releasing the bolt for opening movement of the door without retraction of the bolt into the door.

In a case where the device is a lock and the obstructing element, when in the obstructing position, limits or prevents movement of a key-receiving member of the lock relative to the housing of the lock, the preferred device further comprises transmitting means for transmitting to the obstructing element, to move same into its obstructing position, motion from a key which has been applied to the key-receiving member and is being withdrawn therefrom. With this arrangement, reliance is not placed upon gravity, a spring or other biasing means to ensure that the obstructing element is set in its obstructing position when the key is withdrawn.

Alternative arrangements may be made for positively displacing the obstructing element to its obstructing position if biasing means associated with the obstructing element fails to operate satisfactorily or in the absence of such biasing means. For example, in a case where the obstructing element is arranged for restraining movement of a bolt relative to a housing, means may be provided for transmitting motion from the bolt to the obstructing element as the bolt moves into a secure position, in order that the obstructing element will be displaced positively into its obstructing position. The arrangement may also ensure that the bolt cannot fully attain its secure position unless the obstructing element attains the obstructing position. A similar arrangement may be provided in a case where the obstructing element is arranged for obstructing motion of some other component of a lock relative to a housing.

According to a second aspect of the present invention, there is provided a lock comprising a hollow housing, a key-receiving member mounted in the housing for movement relative thereto and a locking element movable between a locking position in which the locking element obstructs or limitsmovement of the key-receiving member relative to the housing and a releasing position in which the locking element does not so obstruct or limit relative movement, wherein there is provided transmitting means for transmitting to the locking element, to move same into its locking position, motion from a key which has been applied to the key-receiving member and is being withdrawn therefrom.

The invention also provides the combination of a lock according to the second aspect of the invention and a key.

A third aspect of the invention further provides a method of operating a lock comprising a housing, a key-receiving member and a locking element movable between a releasing position in which it permits movement of the key-receiving member relative to the housing and a locking position in which the locking element obstructs or limits movement of the key-receiving member relative to the housing, wherein a key is introduced into the key-receiving member of the lock, the locking element is moved from the locking position to the releasing position, the key-receiving member is moved relative to the housing and the key is subsequently withdrawn from the key-receiving member and wherein the key is held captive by the lock until the locking element has moved into its locking position.

According to a fourth aspect of the invention, there is provided a lock comprising a hollow housing, a key-receiving member mounted in the housing for movement relative thereto, locking means for releasably restraining movement of the key-receiving member relative to the housing and signalling means responsive to insertion of the proper key into the key-receiving member to provide a release signal, wherein the locking means includes first and second relatively movable elements and an electrically energisable motor for moving said first element relative to the housing and to the key-receiving member between a locking position and a releasing position and wherein the first element is arranged for so controlling movement of the second element that, when the first element is in the releasing position, the second element does not interfere with movement of the key-receiving member relative to the housing but movement of the key-receiving member relative to the housing is restrained by the second element when the first element is in its locking position.

By the provision of a second element, having the function of restraining relative movement of the key-receiving member and housing, there can be achieved a robust structure with a solenoid or other motor of relatively small size and having a small power consumption.

The first element is preferably reciprocable by the motor and the second element is preferably movable, when the first element is in its releasing position, with the key-receiving member relative to the first element in a direction transverse to the direction of reciprocation of the first element. The first element may slidably enegage the second element.

Biasing means may be provided for yieldably opposing movement of the second element from a locking position in which the second element obstructs or limits movement of the key-receiving member relative to the housing.

Transmitting means may be provided for transmitting movement from the first element to the second element whenever the first element is moved by the motor between its locking position and its releasing position. In this case, the first and second elements are preferably arranged for reciprocation in respective different directions.

Alternatively, the arrangement may be such that, when the first element is in its releasing position, the second element remains stationary relative to one of the key-receiving member and the housing during relative movement of the key-receiving member and housing and such that, when the first element is in the locking position, movement of the second element with said one of the key-receiving member and the housing is obstructed by the first element which thereby promotes movement of the second element relative to said one of the key-receiving member and housing into a position in which the second element acts between the key-receiving member and the housing. With this alternative arrangement it is not necessary for the motor to provide the force which moves the second element.

The key-receiving member may define a lock axis and be arranged for turning about that axis relative to the housing, the second element being arranged for movement about the lock axis with the key-receiving member relative to the housing when the first element is in its releasing position. The second element may further be arranged for pivoting relative to the key-receiving member when an attempt is made forcibly to turn the key-receiving member relative to the housing whilst the first element is in its locking position.

The pivoting of the second element may be substantially about an axis which is parallel to the lock axis or may be substantially about an axis which is perpendicular to the lock axis.

The biasing means may alternatively be arranged for biasing the second element into a position in which it does not interfere with relative movement of the key-receiving member and housing.

Two second elements may be provided, for interferring with relative movement of the key-receiving member and housing in respective opposite directions.

The or each second element may be provided with a relatively easily deformed portion for engaging with the first element and less easily deformed portions for engaging with the key-receiving member and with the housing respectively. This reduces the risk of damage being caused to the first element in any attempt forcibly to move the key-receiving member relative to the housing whilst the first element is in its locking position.

According to a fifth aspect of the invention, there is provided a security device comprising a housing, an output element mounted for movement relative to the housing, a key-receiving member mounted for movement relative to the housing and relative to the output element and control means for controlling the transmission of drive from the key-receiving member to the output element, wherein the control means includes a clutch which is settable in either one of a driving condition in which drive can be transmitted via the clutch to the output element from a key applied to the key-receiving member, and a non-driving condition, electrically energisable setting means for setting the clutch in at least one of said conditions, reading means for reading data from a key when applied to the key-receiving member and verifying means for verifying said data as data acceptable to the control means and energising the setting means accordingly.

The key-receiving member is preferably freely rotatable relative to the housing and relative to the output element, when the key is absent.

In the preferred device, means is provided for maintaining the clutch in a condition in which it has been set without continuous electrical energisation of the setting means. Thus, a brief pulse of electrical energy may be applied to the setting means to set the clutch in a selected condition, the clutch then remaining in that selected condition without further energisation of the setting means.

According to a sixth aspect of the invention, there is provided a method of controlling movement of a member relative to a body wherein an obstructing element disposed in an opening defined by the member moves with the member relative to the body, the member moves relative to the body from a first position in which the obstructing element is held by the body in said opening to a second position in which the opening defined by the member is aligned with an opening defined by the body, the obstructing element moves partly into the opening defined by the body and so obstructs reversal of said movement of the member, the obstructing element is subsequently driven by electrically energisable driving means out of the opening defined by the body into the opening defined by the member and said movement of the member relative to the body is then reversed.

According to a further aspect of the invention, there is provided a method of controlling the transmission of drive from a user to a driven device, wherein there are provided a key which can be carried by the user to the vicinity of the driven device, a body which remains adjacent to the driven device, a key-receiving member mounted in the body for movement relative thereto, a driven member mounted in the body for movement relative to the body and relative to the key-receiving member and coupled with the driven device and a transmission element settable in a selected one of a driving condition in which the transmission element is able to transmit drive from the key-receiving member to the driving member and a non-driving condition, wherein the transmission element is initially in the non-driving condition and the key-receiving member is free to rotate relative to the driving member, the key is applied by the user to the key-receiving member, the transmission element is set in the driving condition, drive is transmitted to the driven device from the user via the key, the key-receiving member, the transmission element and the driving member, the key is subsequently withdrawn and the transmission element is set in the non-driving condition.

Examples of locks embodying the present invention will now be described, with reference to the accompanying drawings, wherein.

Figure 1:
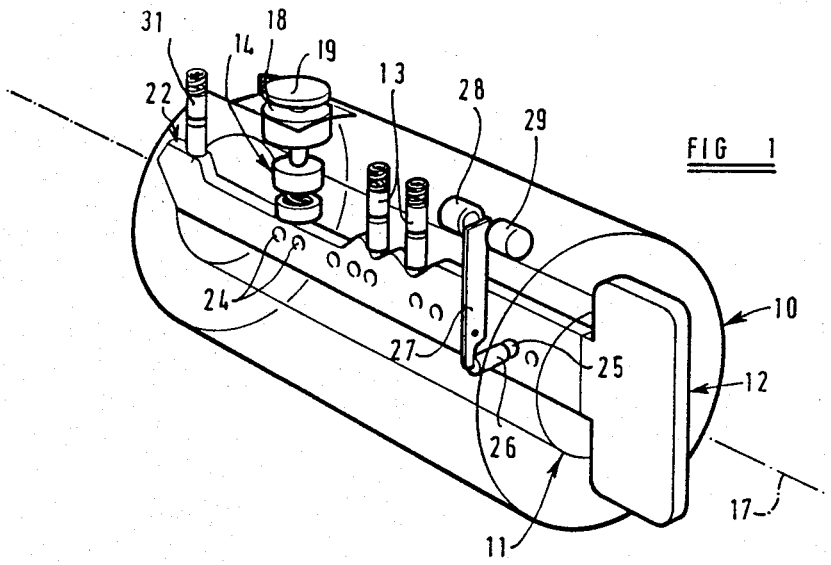
FIG. 1 is a diagrammatic representation of a perspective view of a lock and key.

The lock illustrated in FIGS. 1 to 4 of the drawings comprises a hollow housing 10 which would normally be fixed with respect to a supporting structure (not shown) in use. A key-receiving member 11 is mounted in the housing 10 for movement relative thereto when the proper key 12 is present in a slot defined by the member 11. The lock may incorporate tumblers 13 for restraining movement of the member 11 relative to the housing, when the key is absent. These tumblers may be arranged in a known manner, the key 12 being adapted to engage the tumblers when the key is introduced into the key-receiving member, and to move each tumbler to a respective releasing position, as is well known. Alternatively, the tumblers 13 may be omitted.

The lock comprises additional locking means for restraining or limiting movement of the member 11 relative to the housing, in the absence of the key. The additional locking means includes a locking element 14 which, in the example illustrated, is of cylindrical form. The additional locking means further comprises a transmitting element 15 and biasing means in the form of a spring 16. The spring is interposed between the elements 14 and 15 and urges these elements apart. As shown in the drawing, at least one of the elements 14 and 15 may be formed as a cup, with the spring at least partly received inside the element.

The key-receiving member 11 of the particular lock illustrated is arranged for rotation relative to the housing 10 when the proper key has been introduced into the member 11. The axis of relative rotation is indicated in FIG. 1 by the reference numeral 17. It will be understood that alternative arrangements may be used, for example arrangements providing for relative reciprocatoin of the key-receiving member and housing.

The locking element 14 is mounted in an opening at an external surface of the member 11 and is guided by the boundary of that opening for reciprocation relative to the housing 10 and member 11 along a path which is perpendicular to the axis 17. There is mounted in the housing 10, adjacent to the locking element 14, an electrically energisable motor in the form of a solenoid 18 having an armature 19 also guided for reciprocation in a direction the solenoid has an output element 20 which may be fixed to the armature 19 and which bears against a flat surface of a locking element 14. The output element is preferably formed of non-magnetic material and may be a sliding fit in a hollow core of the solenoid. In the example illustrated, the armature is adjacent to one end of the winding of the solenoid and never enters the core of the solenoid. Alternatively, the armature may include a portion having a sufficiently small diameter to penetrate into the hollow core of the solenoid, in which case the output element 20 would constitute a tip on one end of the armature.

The transmitting element 15 is mounted in the key-receiving member 11 normally to protrude into the key-slot from the opening containing the locking element 14. The transmitting element and key-receiving member are provided with mutually co-operating abutments (not shown) which limit approach of the element 15 towards the axis 17.

Movement of the armature 19 and output elements 20 in a direction towards the axis 17 is limited by engagement of the armature with an end face of the solenoid. Movement of the armature and output element in the opposite direction is limited by a housing (not shown) provided to enclose the solenoid and armature.

Figure 2:
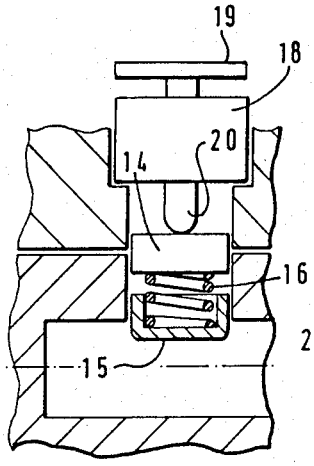
FIGS. 2, 3 and 4 illustrate certain parts of the lock and key of FIG. 1 during successive stages of operation.

When the key is absent, the locking element 14 occupies the position illustrated in FIG. 2, in which approximately one half of the locking element is disposed in the opening defined by the key-receiving member 11 and the other half of the locking element protrudes into a corresponding opening in the housing 10. Movement of the lockingelement from the locking position in a direction away from the axis 17 is prevented by the solenoid and armature 19. Whilst the key is absent, the locking element is retained in the locking position by the action of the spring 16.

As also shown in FIG. 2, when the key is absent the transmitting element 15 is spaced substantially from the locking element 14 and protrudes into the key-slot. The key 12 has on its leading end a chamfer 21 which, upon insertion of the key into the member 11, engages the transmitting element and drives the transmitting element away from the axis 17 until it no longer protrudes into the key-slot. A leading end portion 22 of the key can then move past the transmitting element into the position illustrated in FIG. 3. Whilst the locking element is in its locking position, that element does not obstruct movement of the transmitting element 15 in a direction away from the axis 17 sufficiently to leave the key-slot, although such movement does compress the spring 16.

Figure 3:
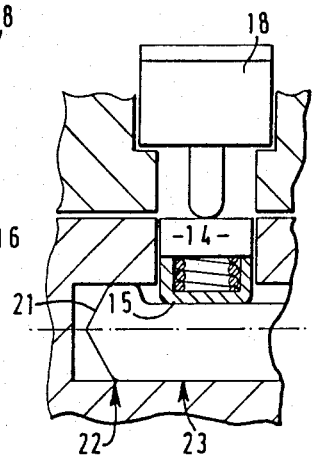

As illustrated in FIG. 3, an intermediate portion 23 of the key which is immediately adjacent to the transmitting element 15, when the key has been fully inserted, has a width substantially less than the width of the end portion 22 and presents towards the transmitting element a surface which is nearer to the axis 17 than is the corresponding surface presented by the end portion. Once the end portion has moved past the transmitting element, the latter is free to move towards the axis 17 to the position illustrated in FIGS. 2 and 3. In this position, the transmitting element is effective to retain the key in the key-slot by obstructing movement of the end portion 22 past the transmitting element.

The key bears information identifying the key and represented by openings 24 or other formations arranged in a row extending along the key. Reading means is provided for reading information from the openings 24 during insertion of the key into the member 11. The reading means includes a spherical contact element 25 mounted in the member 11 for reciprocation towards and away from the key-slot and arranged to protrude into the key-slot, in the absence of the key. The reading means further comprises a pin 26 also mounted in the member 11 for reciprocation with the contact element, a spring-loaded lever 27 pivotally mounted in the housing 10, a light-emitter 28 and a light-detector 29 both mounted in fixed positions within the housing 10. One end portion of the lever 27 can move into a position between the emitter 28 and detector 29 to interrupt the transmission of radiation through an aperture in a wall therebetween. During insertion of the key, the follower 25 moves into and out of successive openings 24, causing reciprocation of the pin 26 and rocking of the lever 27 which amplifies the motion and intermittently interrupts the transmission. The detector provides an electrical signal representing the information borne by the key and this signal is applied to an electronic processor (not shown).

The processor compares information read from the key with information stored in a memory of the processor and, if a appropriate, provides an output signal which causes energisation of the solenoid 18. When the solenoid is energised, the armature 19 is caused to move towards the axis 17 to the position illustrated in FIG. 3. In so moving, the armature moves the locking element 14 to the releasing position, also illustrated in FIG. 3, in which the locking element is contained entirely within the key-receiving member 11. In this position, the locking element no longer obstructs movement of the member 11 relative to the housing 10. Provided the tumblers 13, if present, have been moved by the key to their releasing positions, the member 11 can then be turned about the axis 17 relative to the housing. Such turning causes the locking element 14 to slide on the tip 20 of the armature in a direction arond the axis 17, until the locking element is clear of the armature tip and bears against an internal surface of the housing 10. Contact between this internal surface and the locking element maintains the locking element in the releasing position illustrated in FIG. 3.

It will be noted that, whilst the locking element is maintained in the releasing position shown in FIG. 3, it maintains the transmitting element 15 also in the position illustrated in FIG. 3, in which position the transmitting element protrudes into the key-slot and obstructs movement of the end portion 22 of the key out of the key-slot. Thus, the key is maintained captive in the member 11 until that member is turned about the axis 17 to a position where the locking element 14 is aligned with the opening in the housing 10 which contains the solenoid 18 or a similar opening. Generally, only one such opening will be provided so that the key can be withdrawn only when the member 11 occupies a predetermined rotational position relative to the housing 10.

When provided, the tumblers 13 maintain the key-receiving member 11 in such a position relative to the housing 10 that the locking element 14 is properly aligned with the openings in the housing 10 and key-receiving member 11 until the key is fully inserted into the key-slot. Whilst properly aligned with these openings, the locking element can move between its locking and releasing positions without binding. Reading of information from the key is preferably completed before insertion of the key is fully completed, so that the solenoid can be energised just before movement of the tumblers 13 into their respective releasing positions is completed. In this way, the tumblers prevent binding of the locking element before that element has reached its releasing position. A releasable detent may be provided in addition to or in place of the tumblers 13 for inhibiting rotation of the key-receiving member 11 relative to the housing 10 until the locking element 14 has reached its releasing position. Such detent may comprise a spring-loaded ball guided for movement in a bore of the housing 10 and engageable in a complementary recess in the key-receiving member 11. The pin 26 and lever 27 are preferably so arranged that they do not obstruct rotation of the member 11 relative to the housing either when the key is fully inserted or when the key is absent from the key-slot.

Figure 4:
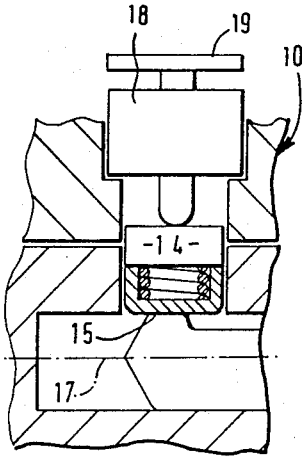

The key-receiving member 11 may be used for transmitting torque from the key 12 to a bolt or other associated device or for controlling operation of an associated device, in a known manner. After operation, the key-receiving member 11 is turned back to its initial position relative to the housing 10, bringing the locking element 14 into alignment with the opening in the housing 10 which contains the solenoid 18. Once such alignment has been achieved, the spring 16 will usually move the locking element away from the transmitting element 15 into its locking position. It will be understood that the solenoid 18 is de-energised, once the locking element has been moved out of alignment with the armature tip 20. Once the locking element has moved into its locking position, the key can be withdrawn from the key-slot because the transmitting element 15 is free to move, under the action of pressure exerted by the end portion 22 of the key, out of the key-slot, as shown in FIG. 4. Even if the spring 16 does not move the locking element to its releasing position, withdrawal of the key is still possible because pressure exerted by the end portion 22 on the transmitting element 15 will drive both the transmitting element and the locking element 14 away from the axis 17 to the position shown in FIG. 4. Thus, the transmitting element ensures that the locking element is driven positively into its locking position, should the spring fail to achieve this.

The tumblers 13 lie at respective positions along the axis 17 which are between the position occupied by the locking element 14 and the position of the follower 26. A further tumbler, 31 occupies a position spaced from the tumblers 13 along the axis 17 beyond the locking element 14. When the key has been inserted into the key-receiving member 11, the leadig end portion 22 of the key engages the tumbler 31 and so positions that tumbler that it no longer restrains rotation of the key-receiving member relative to the housing 10. In the absence of the key, a part of the tumbler 31 lies partly in the key-receiving member and partly in the housing to prevent relative rotation, in the usual manner. Furthermore, if there is applied to the lock a key having a leading end portion which has the same width as does an intermediate portion of the key, then such leading end portion would not move the tumbler 31 into a releasing position. If the leading end portion of the key is sufficiently wide to position the tumbler 31 in the releasing position, then it also sufficiently wide to ensure that the locking element 14 is moved into the locking position, when the key is withdrawn. The tumbler 31 may be provided in a case where the tumblers 13 are omitted.

Whilst, for convenience of illustration, reading means for reading information from a single row of openings in the key has been illustrated, the key would normally be formed with at least two rows of openings, for example two rows of recesses, the recesses of one row opening at one side of the key and the recesses of the other row opening at the other side of the key. Alternatively, the key could be formed with two rows of apertures, the rows being offset from one another laterally with respect to the key. For each row of openings in the key, there would be provided in the lock a respective follower pin, lever, emitter and detector. One row of openings in the key may constitute a clocktrack, which determines the times at which the or each other row of openings will be interrogated by the electronic processor.

When the locking element 14 is in the locking position, the armature 19 of the solenoid is spaced from the winding of the solenoid. There may be associated with that winding a pole piece of magnetic material which is engaged by the armature, when the solenoid is energised and the locking element is moved to the releasing position. Residual magnestism in the armature and pole piece will then maintain the armature in the position illustrated in FIG. 3, without continued energisation of the solenoid. Thus, the output element 20 is effectively latched by magnetic forces in the releasing position. In a case where the output element is required to be latched in the releasing position, the spring 16 would be a light spring and reliance would be placed upon the end portion of the key to ensure return of the locking element and output element to their respective locking positions, shown in FIG. 4. It will be understood that, if the output element is latched in the releasing position, it is necessary to energise the solenoid for only a brief period, for example a few milli-seconds. This conserves the source of electrical power, as compared with energisation of the solenoid until the key has been turned to move the locking element 14 out of alignment with the recess in the housing 10.

The pin 26 of the reading means is preferably so arranged that, in the absence of the key, it lies partly in the member 11 and partly in the housing 10, thereby restraining rotation of the member 11. When the key has been fully inserted, the pin comes to rest in a position in which it lies entirely within the member 11 and does not then obstruct rotation. Alternatively, the pin 26 may be divided into two parts, namely a part which lies nearer to the axis 17 and always lies entirely within the member 11 and an outer part which, when the key is absent, lies partly in the member 11 and partly in the housing 10 and, when the key has been inserted, lies entirely in the housing 10. It will be noted that the lever 27 must be moved, in order to release the member 11 for rotation relative to the housing. This initial movement of the lever may be used to provide a signal which alerts the electronic processor. The processor may be arranged to provide an alarm signal unless the proper key is read within a predetermined period following initial movement of the pin 26 and lever 27. Such alarm signal may ensure that the lock remains in a secure condition for a predetermined period and/or energise a remote alarm device.

By way of example, two only tumblers 13 have been shown in the drawings but normally a larger number of tumblers would be provided for operation by the key.

Figure 5:
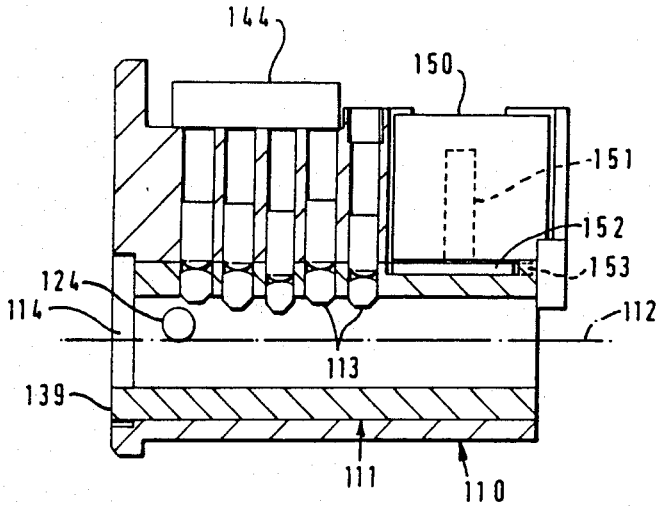
FIG. 5 shows a cross-section of a second example of lock in a plane containing an axis of the lock.
Figure 6:
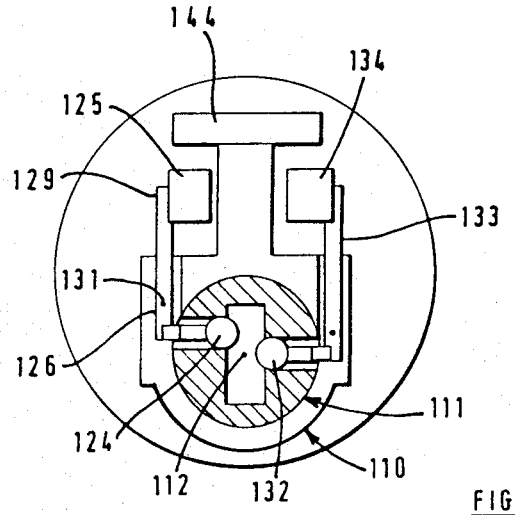
FIG. 6 illustrates a cross-section of the lock of FIG. 5 in a plane perpendicular to the axis of the lock.

The lock illustrated in FIGS. 5 and 6 comprises a housing 110 containing a key-receiving member 111 arranged for turning relative to the housing about on axis 112. Tumblers 113 are provided for restraining turning when the key is absent and reading means comprising first and second signalling means are provided for reading information from the key generally in the manner hereinbefore described.

The housing 110 of the lock shown in FIGS. 5 and 6 has the form of a housing of a profile lock, comprising a generally cylindrical portion with a projection along one side of the cylinder. It will be noted that the tumblers and reading means are all contained within the profile of the housing, so that the lock of FIG. 5 can be substituted for a known profile lock.

The lock illustrated in FIGS. 5 and 6 comprises certain parts which correspond to those hereinbefore described with reference to FIGS. 1 and 2. In FIGS. 5 and 6, certain corresponding parts are indicated by like numerals with the prefix 1 and the preceding description is deemed to apply to those corresponding parts, except for the differences hereinafter mentioned.

In the lock of FIG. 5, the first and second signalling means are mounted beside that portion of the housing 110 which contains the tumblers. In a case where there are only two followers, these are preferably at opposite sides of the key-slot, the corresponding signalling means being at opposite sides of the tumblers. In a case where four followers are provided, there would be two followers at each side of the key-slot and two signalling means at each side of the tumblers. It will be noted that the signalling means of the lock of FIG. 5 are relatively near to the outer end face 139 and that the levers constituting the transmission means pivot about axes which are parallel to the axis 112. Each lever is arranged with its length generally transverse to the length of the key-receiving member. Furthermore, the levers lie outside the key-receiving member and are mounted in a carrier (not shown) which is a snap-fit on the housing 110. Additional elements may be interposed between the levers and the contact elements, in a case where the latter are balls. Alternatively, the contact elements may be elongated. The arrangement is such that, when a key has been fully inserted into the key-receiving member 111, the levers lie outside that member so that the levers do not impede rotation of the member 111 relative to the housing 110.

Adjacent to an inner end of the row of tumblers, there is mounted in the housing 110 an electrically energisable motor 150 which, in the example illustrated, is a solenoid arranged with its axis perpendicular to the axis 112. An armature 151 of the solenoid is urged by a spring (not shown) towards a projected position, in which an end portion of the armature protrudes from the housing 110 towards the key-receiving member 111. When the solenoid is energised, the armature is withdrawn into the housing 110.

There is interposed between the solenoid 150 and the key-receiving member 111 a rectangular plate-like element 152 formed with an aperture in which the end portion of the armature 151 can be received, when the latter is in its projected position. A notch in an edge of the element 152 receives a projection 153 which is on the member 111. This projection is spaced substantially from the armature 151. The element 152 is confined to the space between the member 111, on the one hand, and the housing 110 and solenoid 150, on the other hand. Furthermore, movement of the element 152 is restricted by the projection 153 and by the armature 151, when the latter is in its projected position. The element 152 is not, however, fixed with respect to any other component.

If the member 111 is turned relative to the housing 110 whilst the armature 151 is retracted, the element 152 turns freely with the member 111 and turning of the member 111 is not impeded. If an attempt is made forcibly to turn the member 111 relative to the housing 110 whilst the armature is in its projected position, the element 152 will be pivoted slightly about the armature so that corners of the element 152 jam against the internal surface of the housing 110. The element 152 is then capable of transmitting torque from the member 111 to the housing 110 and thereby preventing relative rotation. It will be noted that such torque is not transmitted entirely through the armature 151 and the armature is unlikely to be sheared.

Figure 7:
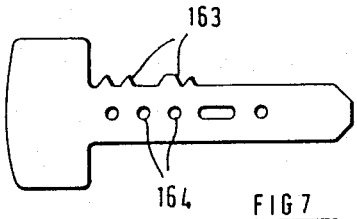
FIG. 7 illustrates a key suitable for use with the lock of FIGS. 5 and 6.

The lock of FIG. 5 is intended for use with a key shown in FIG. 7 having along a minor face formations 33 for co-operation with the tumblers and having on at least one major face recesses 34 representing information which can be read by the reading means. When an appropriate key is inserted into the lock, each tumbler is displaced to a releasing position in which it no longer prevents rotation of the member 111 relative to the housing 110. The microprocessor 144 compares information read from the key with stored information and, if appropriate, provides a control signal for energising the solenoid 150 to retract the armature. The member 111 is then free to be turned by means of the key to operate an associated device, for example a latch or lock, in a known manner.

Figure 9:
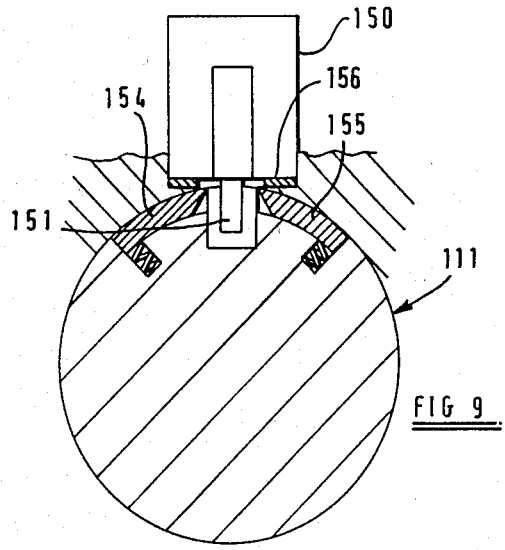
FIG. 9 illustrates the modification of FIG. 8 by a cross-section in a plane transverse to the axis of the lock.
Figure 8:
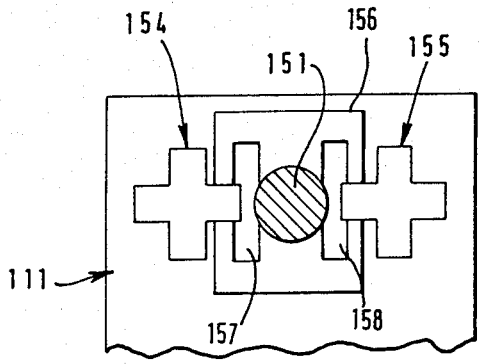
FIG. 8 illustrates a modification of the lock of FIG. 5 by a plan view of certain parts.

The lock of FIGS. 5 and 6 may be modified in the manner illustrated in FIGS. 8 and 9. In this modification, the element 152 is substituted by a pair of plate-like elements 154 and 155 which are mounted in a recess provided in the external surface of the member 111 so as to lie at opposite sides of the armature 151 when the latter is in its projected position. As viewed in a direction towards the axis 112, each of the elements 154 and 155 is of cruciform shape. Mutually remote end portions of these elements are acted on by respective resilient components which urge the mutually remote end portions away from the axis into engagement with the inwardly facing surface of the housing 110 and thus normally prevent mutually adjacent end portions of the elements 154 and 155 from projecting outwardly from the member 110. When the armature is in the retracted position, the elements 154 and 155 can turn freely inside the housing 110 with the member 111.

The housing 110 incorporates a plate 152 which lies between the solenoid and the member 111. In this plate, there is formed an aperture through which the armature 151 can project into a recess in the member 111. There are also formed in the plate 152 two rectilinear openings 157 and 158. These openings are arranged with their lengths parallel to the mutually adjacent ends of the elements 154 and 155.

The mutually adjacent end portions of the elements 154 and 155 are so chamfered that, if an attempt is made to turn the member 111 relative to the housing 110 whilst the armature 151 is in its projected position, on end portion of one of the elements 154 and 155 will move into contact with the armature and will slide on the armature in a direction away from the axis 112, so that the end portion of the element enters a respective one of the openings 157 and 158. In this position, the element is capable of transmitting torque between the member 111 and the housing 110 and of preventing relative rotation. The torque is not transmitted entirely through the armature 151 and the armature is unlikely to be damaged. Those portions of the elements 154 and 155 which may engage the armature 151 may be adapted by their shape and/or hardness to be deformed relatively easily, to further reduce the risk of damage being caused to the armature.

Figure 10:
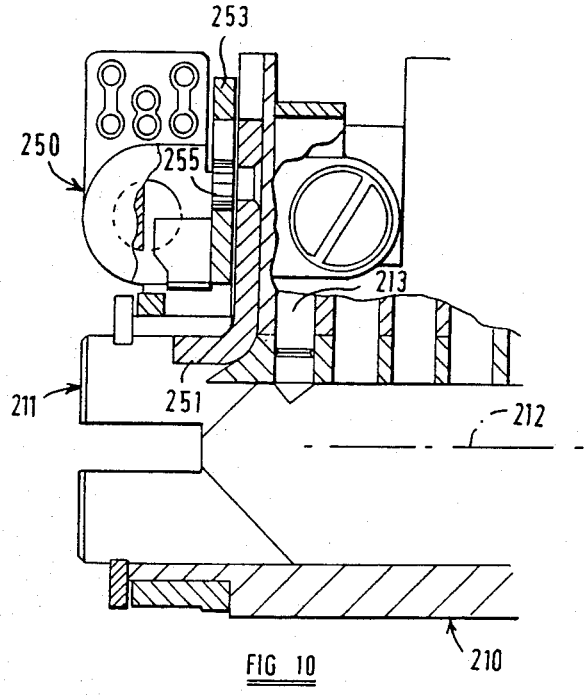
FIG. 10 shows a cross-section of a third lock in a plane containing an axis of the lock.
Figure 11:
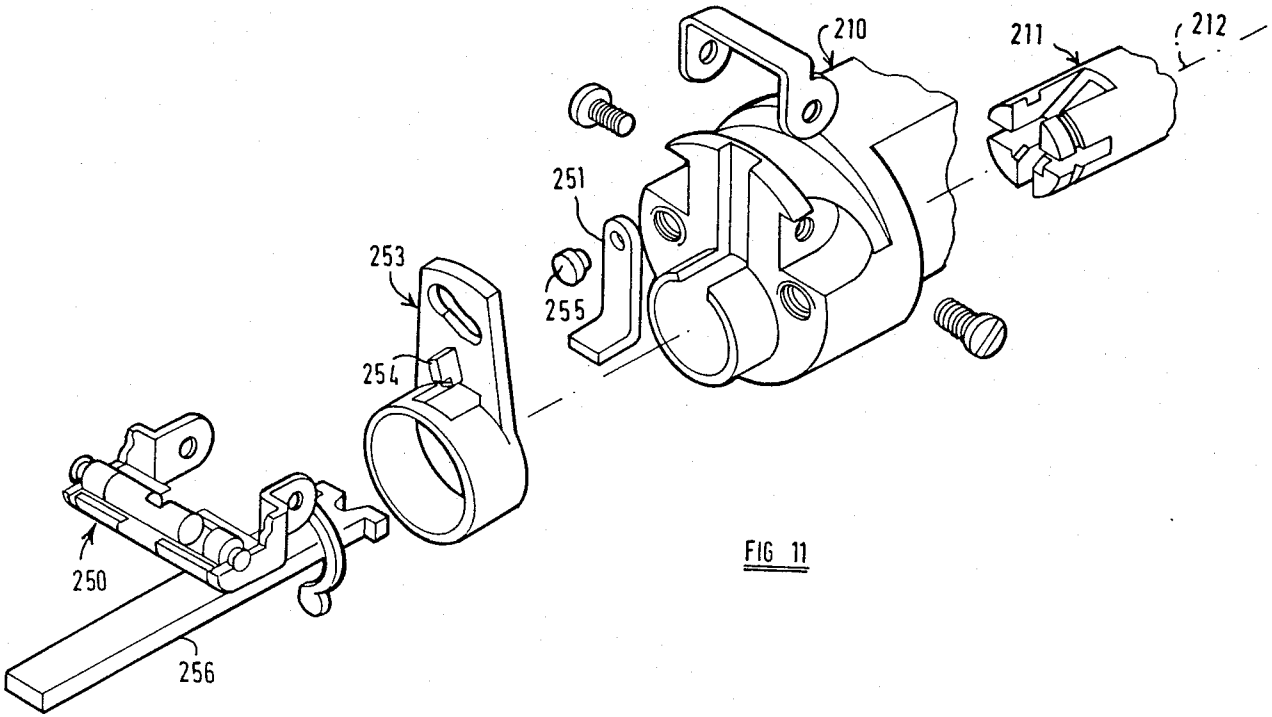
FIG. 11 shows parts of the lock of FIG. 10 separated from each other.

The lock illustrated in FIGS. 10 and 11 has certain parts corresponding to parts hereinbefore described with reference to FIG. 1. In FIGS. 10 and 11, such corresponding parts are indicated by like reference numerals with the prefix 2 and the preceding description is deemed to apply, except for the differences hereinafter mentioned. The followers, signalling means and transmitting means are not shown in FIGS. 10 and 11 but may be arranged in the same manner as those of the lock of FIGS. 5 and 6.

There is mounted on the housing 210 a motor in the form of a solenoid 250 having an armature arranged for reciprocation along a path which is perpendicular to but is offset from the axis 212. A bolt 251 is mounted in the housing 110 for reciprocation towards and away from the axis 212 between a retracted position, in which it is clear of the key-receiving member 211 and a projected position in which it engages in a recess formed in the member 211.

For transmitting motion between the armature 252 of the solenoid 250 and the bolt 251, there is provided a cam 253 which is mounted for movement relative to the housing 210 about the axis 212. A tooth 254 on the cam engages in a recess defined by the armature so that reciprocation of the armature causes rocking of the cam about the axis 212. The cam co-operates with a cam follower 255 on the bolt 251 so that rocking of the cam about the axis 212 reciprocates the bolt towards and away from that axis. It will be noted that movement of the bolt which is caused by the armature 252 occurs in a direction radially of the axis 212, whilst movement of the member 211 relative to the housing 210 is about that axis. Accordingly, an attempt forcibly to turn the member 211 whilst the bolt is in a projected position does not cause any force to be transmitted through the armature 252.

The member 211 is provided with a tongue 256 for driving an associated device, for example a latch or a bolt.

The armature of FIG. 5, the armature of FIGS. 8 and 9 and the armature of FIGS. 10 and 11 all interfere mechanically with the movement of one or more further elements to restrain relative movement of the key-receiving member and housing.

Each of the locks hereinbefore described has a microprocessor connected electrically with the reading means of the lock. Also connected with the microprocessor is a switch for providing an entry signal when a key is first introduced into the key-slot. Such switch may be associated with a shutter which normally closes the key-slot. Operation of this switch when insertion of a key is commenced instructs the microprocessor to become active and to energise intermittently the diode corresponding to that follower which is aligned with the clocktrack of the key. When the leading end of the key reaches this follower, the follower is moved and an appropriate signal is provided to the microprocessor. If that follower does not move into a recess of the clocktrack within a predetermined period, for example 2.5 seconds, then the microprocessor assumes a default condition and energisation of the solenoid or other motor is prevented.

The microprocessor continues to energise intermittently the diode corresponding to the clocktrack until coincidence of a first formation of the clocktrack with the follower has been detected and confirmed. The diode associated with the follower which corresponds to the information track of the key is then energised to interrogate the key at a predetermined position relative to the first formation of the clocktrack. The diode corresponding to the clocktrack is then energised intermittently and the process is repeated until the key has been fully inserted. This is signalled to the microprocessor and the time which has elapsed since insertion of the key is checked. If this exceeds 2.5 seconds, the microprocessor assumes the default condition.

The intervals between successive energisations of that diode which corresponds to the information track on the key are compared with a predetermined period and, if any one or more of these intervals is found to be shorter than the predetermined period, the microprocessor assumes the default condition, in order to avoid the possibility of an error resulting from excessively rapid insertion of the key. The number of bits read from the clocktrack is compared with the expected number and, if there is a difference, the microprocessor assumes the default condition. If the default condition is not assumed, then data read from the information track of the key is compared with data previously stored by the microprocessor and, if correspondence is found, an electrical output signal is provided and is used, for example, to energise the solenoid or other motor and permit rotation of the key-receiving member relative to the housing.

Whilst we prefer that the key positions the followers and levers of the reading means so that these do not interfere with nmovement of the key-receiving member, when the key has been fully inserted, the arrangement may be such that a lever or follower part still protrudes from the housing into the key-receiving member and that such part is driven out of the key-receiving member by a camming action upon turning of the key-receiving member.

Figure 12:
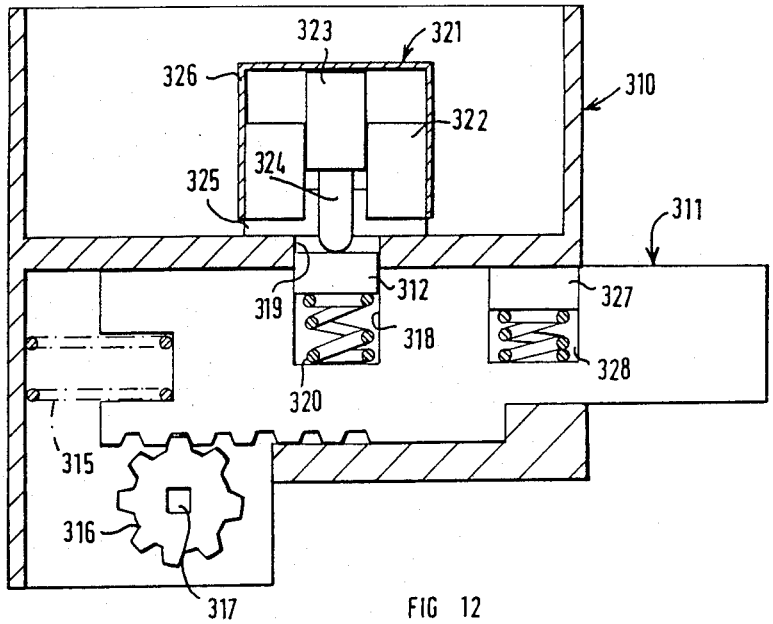
FIG. 12 shows a diagrammatic representation of a cross-section through a latch in a locked condition.
Figure 13:
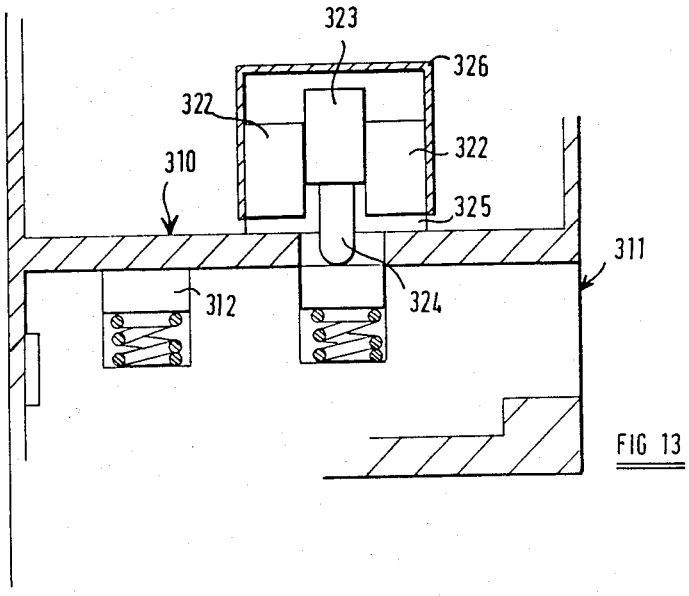
FIG. 13 illustrates the unlocked condition of the latch.

The security device illustrated in FIGS. 12 and 13 is a latch comprising a hollow body 310 and a ball 311 mounted in the body for movement between a projected position shown in FIG. 1, in which an end portion of the bolt protrudes from the body and a retracted position in which the bolt lies entirely within the body. The latch may be fitted in a door in a known manner for co-operation with a keeper to hold the door closed until an appropriate signal is provided to the latch.

For holding the bolt in the projected position, there is provided on obstructing element 312 which is engageable with both the body 310 and the bolt 311 and which is movable between the obstructing position illustrated in FIG. 12, in which the element 312 lies partly in an opening 313 in the bolt 311 and partly in an opening 314 in the body 310, and the releasing position illustrated in FIG. 13, in which the obstructing element lies entirely within the opening 313 of the bolt.

For moving the bolt from the retracted position to the projected position, there is provided a coiled compression spring 315 which acts between the body and the bolt. For moving the bolt from the projected position to the retracted position, when the obstructing element 312 occupies its releasing position, there is provided transmission means for transmitting movement from a handle (not shown) to the bolt. The transmission means illustrated comprises a pinion 316 which is enmeshed with a rack formed on the bolt and a shaft 317 which couples the pinion with the handle.

If an attempt is made to move the bolt from the projected position to the retracted position whilst the obstructing element is in the obstructing position, an abutment face 318 on the bolt, which forms a part of the boundary of the opening 313, bears against the element 312 under pressure and the obstructing element bears under pressure against an abutment face 319 on the body which forms a part of the boundary of the opening 314. The faces 318 and 319 face generally towards each other and whilst the abutment element is interposed between them, it prevents movement of these faces towards each other and so obstructs movement of the bolt to the retracted position. In its obstructing position, the obstructing element is overlapping relation with both of the faces 318 and 319. In its releasing position, shown in FIG. 13, the obstructing element is out of overlapping relation with the face 319 but remains in overlapping relation with the face 318. However, the obstructing element is then free to participate in movement of the bolt 311 relative to the body 310.

A spring 320 is provided in the opening 313 to act between the bolt 311 and the obstructing element 312 and urge the obstructing element towards its obstructing position. For driving the obstructing element from the obstructing position to the releasing position, there is provided electrically energisable driving means 321 which is mounted in the body 310 adjacent to the opening 314. The particular example of driving means illustrated in the accompanying drawing has the form of a solenoid comprising an annular winding 322 and an armature 323 formed of a material having a high magnetic permeability. For transmitting motion from the armature to the obstructing element 312, there is provided an elongated transmitting element 324 of substantially non-magnetic material. The driving means further comprises a guide element 325 which guides the transmitting element 324 for reciprocation along a path which passes centrally through the opening 314.

The transmitting element 324 is normally maintained in contact with both the armature 323 and the obstructing element 312 by the action of the spring 320. Movement of these components in a direction away from the opening 313 in the bolt is limited by a casing 326 of the driving means. Movement of the armature in the opposite direction is limited by engagement of an end face of the armature with the guide element 325. As shown in FIG. 12, when the obstructing element 312 occupies its obstructing position, the armature 232 lies partly inside and partly outside the winding 322. When the latter is energised by passing an electric current through the winding, the armature is drawn into the winding to abut the guide element 325 and displace the obstructing element to its releasing position shown in FIG. 2. The solenoid and the guide element 325 are fixed with respect to the body 310. It will be noted that, when the armature abuts the guide element 325, the transmitting element 324 does not protrude into the opening 313 of the bolt. Thus, the driving means does not impede movement of the bolt and obstructing element relative to the body. When the bolt is in its retracted position, the obstructing element bears against an internal face of the body 310 and is held by that face in its releasing position. Energisation of the driving means 321 can be terminated, once the bolt has been moved a part of the way from the projected position to the retracted position, without further movement being obstructed.

The body 310 and bolt 311 are provided with co-operating abutments for limiting travel of the bolt relative to the body in a direction from the retracted position to the projected position, so that the bolt cannot move beyond that position in which the opening 313 is aligned with the opening 314. To facilitate movement of the obstructing element 312 into the opening 314, the entrance to that opening may be flared. Alternatively, the diameter of the opening 314 may be somewhat greater than the diameter of the opening 313 and of the obstructing element 312. It is preferred that the obstructing element is a free-sliding fit in the opening 313, in order that the bolt can guide the obstructing element. Whilst both of the openings 313 and 314 are preferably circular, as viewed in plan, it will be understood that it is not essential for these openings to have the same shape. The shape of the opening 313 preferably compliments that of the element 312. The shape of the opening 314 may be quite different, for example an elongated slot.

Optionally, there may be provided a further obstructing element 327 mounted in a further recess 328 provided in the bolt 311 at a position spaced along the bolt from the recess 313. The recess 328 may be aligned with the opening 314, when the bolt is in the retracted position. With this arrangement, energisation of the solenoid is required to release the bolt for movement from its projected position and also to release the bolt for movement from its retracted position. However, energisation for only a very brief period is necessary if the solenoid is adapted to latch the transmission element 24 in the position illustrated in FIG. 13. The guide element 325 may be formed of mild steel or other magnetic material so that residual magnetism will hold the armature 323 in the position shown in FIG. 13 after energisation of the solenoid has been termined.

It will be understood that, as an alternative to the provision of two obstructing elements in the bolt, there may be mounted on the body 310 two solenoids for co-operation with a single obstructing element mounted in the bolt, when the bolt is in respective different positions.

The arrangement of obstructing element and driving means illutrated in the accompanying drawing may be used to control relative movement of members which is other than recoprocation. For example, the opening 313 may be formed in a cylindrical key-receiving member of a lock, the opening 314 being formed in a housing of that member. With this arrangement, the key-receiving member would be rotatable relative to the housing when the obstructing element is in the releasing position but relative rotation would be obstructed by the obstructing element in its obstructing position. In a case where the obstructing element is required to control relative rotation of two members, the obstructing element may be received in an opening in a peripheral face of one of the members or in an opening in a face of the member which is presented in a direction along the axis of rotation. The device illustrated in the accompanying drawing may be further modified by substitution for the solenoid of some other form of electrically energisable motor, for example a rotary motor having transmission means for converting rotary movement to reciprocation. The motor may be a piezo electric device having transmission means for amplifying the motion which is imparted to the obstructing element.

Whilst it is convenient to mount the driving means in a stationary member or in a member which is fixed with respect to a larger structure in which the device is mounted, it will be understood that the driving means could be mounted in the bolt 311 to reciprocate relative to the body with the bolt, in which case the obstructing element 312 would remain stationary with the body 310 when the bolt is reciprocated.

Figure 14:
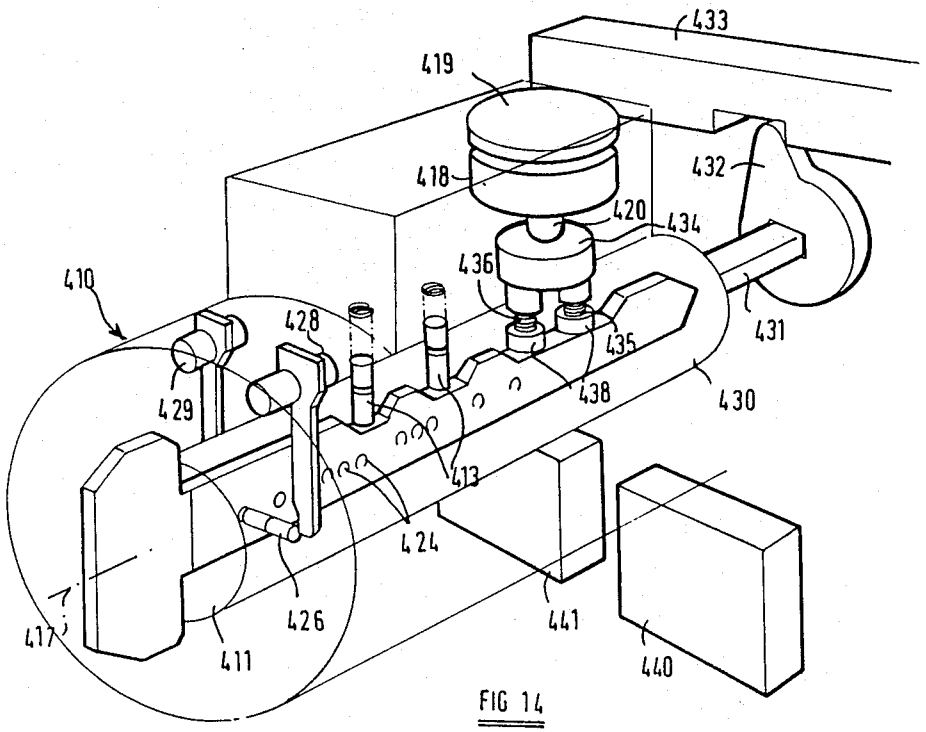
FIG. 14 is a diagrammatic representation of a perspective view of a fourth lock and key.

The security device illustrated in FIG. 14 comprises certain parts which correspond to parts hereinbefore described, with reference to FIGS. 1 to 4. In FIG. 14, such corresponding parts are identified by like reference numerals with the prefix 4 and the preceding description is deemed to apply, except for the differences hereinafter mentioned.

The security device of FIG. 14 includes a cylinder lock mechanism comprising a housing 410 containing a key-receiving member 411 arranged for rotation relative to the housing about an axis 417 and, in the absence of the key, restrained against rotation by tumblers 413 and by pins 426 of reading means. There is also disposed in the housing 410, in co-axial relation with the key-receiving member 411, a driving member 430 which is also rotatable about the axis 417. The driving member is connected by an output shaft 431 with a cam 432 for moving a bolt 433 between a projected position and a retracted position.

If required, the tumblers 413 may be omitted and the pins 426 of the reading means may be so arranged that the key-receiving member 411 is freely rotatable relative to the body 410 in the absence of the proper key. The key-receiving member receives the key with a sliding fit and that part of the key which enters the member 411 has a non-circular transverse cross-section, so that it is adapted to transmit torque to the member 411. The driving member 430 receives an end portion of the key with substantial clearance, so that the key is unable to engage the member 430 and transmit torque thereto directly.

A clutch is provided for transmitting drive from the member 411 to the member 430. The clutch comprises an obstructing element 434 which, when the key is absent, is disposed entirely in a recess formed in an internal surface of the housing 410 adjacent to the members 411 and 430. The latter members are formed with respective recesses which can collectively receive the obstructing element 434, provided these recesses are aligned with the recess in the housing 410.

The obstructing element 434 is urged into the recess in the housing 410 by a pair of springs 435 and 436 disposed respectively in the recesses provided in the members 411 and 430. End portions of these springs nearer to the axis 417 bear against respective transmitting elements 437, 438, each of which is arranged in substantially the same manner as is the transmitting element 15 hereinbefore described. Opposite end portions of the springs are covered by respective caps. These caps bear against the obstructing element 434.

For moving the obstructing element 434 into the recesses of the members 411 and 430, to establish the driving condition of the clutch, there is mounted in the body 410 a solenoid arrangement which is substantially the same as that provided in the lock of FIG. 1.

The device of FIG. 14 may be modified by the provision on the obstructing element 434 of a projection which, when that element is outside the recess in the key-receiving member 411, projects into the recess of the driving member 430. With this modification, when the clutch is in a non-driving condition, rotation of the member 430 relative to the housing 410 is prevented by the obstructing element.

The transmitting elements 438 and 437 are arranged to retain the key in the cylinder lock mechanism until the obstructing element 434 lies in the recess in the housing 410. It will be understood that the obstructing element can move into this recess only after alignment of the recesses in the members 411 and 430 with the recess in the housing 410 has been established. The housing 410 may be formed to obstruct insertionof the key into the member 411, unless the latter is in a position such that the recess defined by the member 411 is aligned with the obstructing element 434.

When the key is absent from the security device of FIG. 14, the clutch is in the non-driving condition. During insertion of the key, data represented by one or more rows of depressions 424 in the key is read by the reading means and is applied to a microprocessor 440 which compares the data read from the key with data stored in the memory of the microprocessor. If the data read from the key is found to be acceptable, the microprocessor provides an output signal which causes electrical power to be applied from a battery 411 to the solenoid 418. The solenoid is energised for a brief period, for example 50 milliseconds. This is sufficient to set the clutch in the driving condition. The driving condition is maintained by residual magnetism, which holds the armature 419 in engagement with the pole piece of the solenoid. The key can then be turned, so that drive will be transmitted from a user via the key, the key-receiving member 411, the obstructing element 434, the driving member 430 and the cam 432 to the bolt 433. When the key is turned, the obstructing element 434 is carried with the key-receiving member 411 away from the recess defined by the housing 410. The obstructing element bears against an internal surface of the housing so that it is confined to the recesses defined by the members 411 and 430. After the bolt has been moved to the retracted position, rotation of the key can be reversed to return the obstructing element 434 to the position in which it is aligned with the recess defined by the housing. If the key is then withdrawn, the transmission elements 435 and 436 drive the obstructing element, output element 420 and armature 419 away from the axis 417 so that the non-driving condition of the clutch is re-established. The non-driving condition will then be retained indefinitely by the springs 435 and 436 until the solenoid is energised once more.

As an alternative to arrangement of the solenoid for latching of the armature by magnetic forces, the output element of the solenoid and the obstructing element may be latched in a position to which they have been set by a mechanical latch, as disclosed in GB No. 2,166,484 to be published on May 8, 1986. There may be associated with such a mechanical latch two solenoids, a respective one for setting the obstructing element in each of the alternative positions. In a further alternative arrangment, the armature may be a permanent magnet and the microprocessor may be arranged for changing the polarity of the solenoid to drive the armature in a selected direction. The armature may be coupled with the obstructing element by coupling means which enables the armature to push and to pull the obstructing element. Furthermore, two obstructing elements may be provided, one resting on the other and these being movable so that either obstructing element can be positioned to restrain relative movement of two members and that both obstructing elements can be positioned to permit relative movement of those members.

Figure 15:
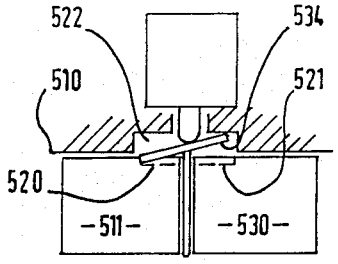
FIGS. 15, 15*a* and 16 illustrate a modification of the lock of FIG. 14.
Figure 16:
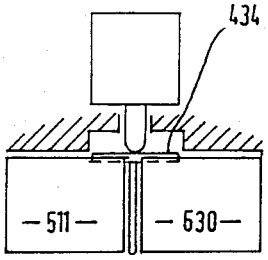
Figure 15A:
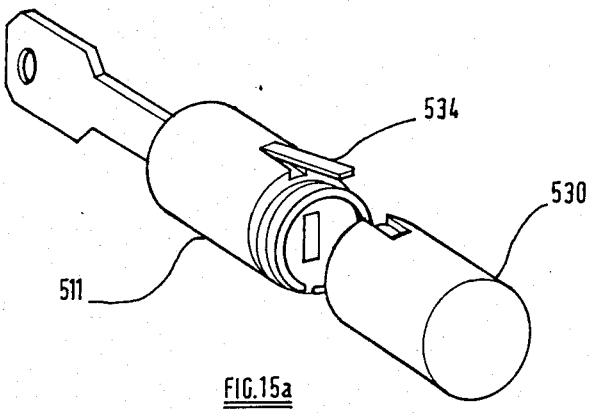
Figure 14A:
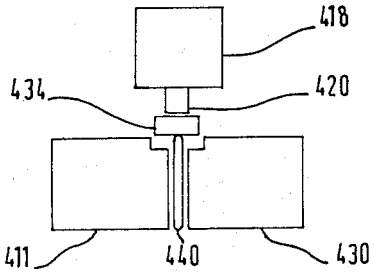
FIG. 14*a* is a diagrammatic representation of certain parts of the lock of FIG. 14.

In FIGS. 15 and 16, there is illustrated a modification of the lock of FIG. 14 with a pair of members, 511 and 530 arranged end-to-end in a housing 510 for rotation relative to the housing about a common axis 517. An obstructing element 534 is mounted in a recess 520 in the member 511 for movement between a position shown in FIG. 15, in which the obstructing element lies partly in a recess 520 of the member 511 and partly in a recess 522 of the member 510 but lies entirely outside the member 530. With the obstructing element in this position, turning of the member 530 relative to the members 510 and 511 is not restrained but turning of the member 511 about the axis 517 relative to the housing is restrained. By means of a solenoid or other electrically energisable device 518 mounted in the housing 510, the obstructing element can be moved into the position shown in FIG. 16, where it lies partly in the recess 520 and partly in a recess 521 in the member 530 but lies entirely outside the recess 522 in the housing. In this position, the obstructing element prevents relative rotation of the members 511 and 530 but permits these members to move together relative to the housing 510. Either one of the members 511 and 530 may be a key-receiving member and the other may be a driving member adapted to transmit drive to an associated device.

The obstructing element 534 may be rectangular and pivoted adjacent to one of its ends to the member 511 for movement relative thereto about a pivot axis which is transverse to the axis 517. A leaf spring may be arranged to act between the member 511 and the obstructing element, to urge the obstructing element to the position shown in FIG. 15. Whilst in other figures of the drawings enclosed herewith, a cylindrical obstructing element has been illustrated, it will be understood that obstructing elements of other shapes, for example square, may be provided.

In each of the locks hereinbefore described, movement of the contact element in a direction towards the axis of rotation of the key-receiving member may be limited by the key-receiving member itself, rather than by the key, so that the contact element can protrude into an opening in the key without touching the boundary of that opening when the opening is fully aligned with the contact element.

The microprocessor of each lock may be arranged to maintain the obstructing element associated with the solenoid in a secure condition when the key is absent. Alternatively, the microprocessor may be arranged to maintain the obstructing element in an unsecure condition when the key is absent and to establish the secure condition of the obstructing element when there is introduced into the key-receiving member a key from which the reading means does not read acceptable data within a predetermined period. In the event of the reading means failing to read acceptable data, for example because an unauthorized key has been applied, the microprocessor would establish the secure condition. As noted above, tumblers may be used to establish a secure condition independently of the microprocessor or reliance may be placed entirely on the electrically controlled obstructing element to establish the secure condition of the device.

The microprocessor of each lock may be adapted to accept respective different data from different keys so that the different keys can be used in succession to operate the lock.

The features disclosed in the foregoing description, or the accompanying drawings, expressed in their specific forms or in terms of a means for performing the disclosed function, or a method or process for attaining the disclosed result, as appropriate, may, separately or any combination of such features, be utilised for realising the invention in diverse forms thereof.

We claim:

1. A security device comprising two relatively movable members, relative movement of which is required to be restrained at some time and control means for selectively obstructing relative movement of said members, wherein the control means comprises an electrically energisable device having an output element which is moved when the device is energised and an obstructing element movable between an obstructing position in which the obstructing element obstructs said relative movement of said members, a releasing position in which the obstructing element does not so obstruct relative movement of said members, wherein the obstructing element is arranged to be moved by the output element in at least one direction between its obstructing and releasing positions and wherein the obstructing element, when in one of its obstructing and releasing positions, is movable with one of said members relative to said electrically energisable device.

2. A security device comprising two relatively movable members, relative movement of which is required to be restrained at some time and control means for selectively obstructing relative movement of said members, wherein the control means comprises an electrically energisable device having an output element which is moved when the device is energised and an obstructing element movable between an obstructing position in which the obstructing element obstructs said relative movement of said members and a releasing position in which the obstructing element does not so obstruct relative movement of said members, wherein the obstructing element is arranged to be moved by the output element in at least one direction between its obstructing and releasing positions and wherein the electrically energisable device is mounted in one of said members and the obstructing element, when in its releasing position, moves with the other of said members.

3. A security device according to claim 2 wherein the electrically energisable device is a solenoid, having an armature of magnetic material, and comprising means for guiding the armature, when the armature is moved by energisation of the electrically energisable device, along a rectilinear path and wherein the obstructing element, when in its releasing position, is movable with the other of said members transversely of said path.

4. A security device according to claim 1 further comprising a housing, means for transmitting drive from an operator to one of said members and means for transmitting drive to a further device from the other of said members, wherein both of said members are mounted in the housing and movable relative to the housing whereby, in use, with the obstructing element in its obstructing position, drive is transmitted from the operator to the one member, from the one member to the obstructing element, from the obstructing element to the other member and from the other member to the further device.

5. A security device according to claim 1 which is a lock, one of said members being a hollow housing and the other of said members being a key-receiving member mounted in the hollow housing for movement relative thereto and the control means comprising signalling means responsive to insertion of the proper key into the key-receiving member to provide a release signal which brings about energisation of the electrically energisable device.

6. A security device according to claim 4 which is a lock, said members being arranged for rotation about a common axis relative to the housing, one of the members being adapted to receive and to be rotated by a key and the other of the members being adapted to drive a bolt or other associated device.

7. A security device according to claim 6 wherein the control means comprises signalling means responsive to insertion of the proper key into the key-receiving member to provide a release signal which brings about energisation of the electrically energisable device.

8. A lock comprising a housing, a key-receiving member in the housing, movement of which member relative to the housing is required to be restrained at some time, and control means for selectively obstructing movement of said member relative to the housing, wherein the control means comprises an electrically energisable device an output element which is moved when the device is energised and an obstructing element movable between an obstructing position in which the obstructing element obstructs movement of said member relative to the housing and a releasing position in which the obstructing element does not obstruct movement of the member, wherein the obstructing element is arranged to be moved by the output element in at least one direction between its obstructing and releasing positions and is separable from the output element and the lock further comprising transmitting means for transmitting to the obstructing element motion from a key which has been applied to the key-receiving member, and is being withdrawn therefrom.

9. A lock according to any claim 5 further comprising transmitting means for transmitting to the obstructing element, to move some into its obstructing position, motion from a key which has been applied to the key-receiving member and is being withdrawn therefrom.

10. A lock comprising a hollow housing, a key-receiving member mounted in the housing for movement relative thereto and a locking element movable between a locking position in which the locking element obstructs or limits movement of the key-receiving member relative to the housing and a releasing position in which the locking element does not so obstruct or limit relative movement, wherein there is provided transmitting means for transmitting to the locking element, to move same into its locking position, motion from a key which has been applied to the key-receiving member and is being withdrawn therefrom, said transmitted motion being in a direction away from said key.

11. A lock according to any claim 8 further comprising biasing means for yieldably opposing movement of said element from its obstructing position.

12. A lock according to claim 11 wherein the biasing means is interposed between said element and the transmitting means.

13. A lock according to claim 5 wherein the electrically energisable device is adapted to maintain said element in the obstructing position without continuous energisation of said device.

14. A lock comprising a housing, a key-receiving member mounted in the housing for movement relative thereto, a driving member, a clutch settable in a driving condition in which it can transmit drive from the key-receiving member to the driving member and settable in a non-driving condition and electrically energisable setting means for the clutch.

15. A lock according to claim 14 comprising means for maintaining the clutch releasably in either one of said conditions in which it has been set.

16. A lock according to claim 14 wherein said key-receiving member is normally freely rotatable relative to the housing.

17. A lock comprising a hollow housing, a key-receiving member mounted in the hollow housing for movement relative thereto, movement of which member relative to the housing is required to be restrained at some time, and control means for selectively obstructing movement of said member relative to the housing, wherein the control means comprises an electrically energisable device having an output element which is moved when the device is energised and an obstructing element movable between an obstructing position in which the obstruction element obstructs movement of said member relative to the housing and a releasing position in which the obstructing element does not so obstruct movement of said member relative to the housing, wherein the obstructing element is arranged to be moved by the output element in at least one direction between its obstructing and releasing positions, wherein the obstructing element is separable from the output element, wherein the control means further comprises signalling means responsive to insertion of the proper key into the key-receiving member to provide a release signal which brings about energisation of the electrically energisable device and wherein the signalling means includes a contact element for contacting a key upon insertion of the key into the key-receiving member, the contact element being movable relative to the key to follow formations of the key, and means for providing an electrical signal in response to movement of the contact element.

18. A lock comprising a hollow housing, a key-receiving member mounted in the housing for movement relative thereto, movement of which member relative to the housing is required to be restrained at some time, and control means for selectively obstructing movement of said member relative to said housing; wherein the control means comprises an electrically energisable device having an output element which is moved when the device is energised and an obstructing element movable between an obstructing position in which the obstructing element obstructs movement of said member relative to the housing and a releasing position in which the obstructing element does not so obstruct movement of said member, wherein the obstructing element is arranged to be moved by the output element in at least one direction between its obstructing and releasing positions, wherein the obstructing element is separable frm the output element, wherein the control means comprises signalling means responsive to insertion of the proper key into said member to provide a release signal which brings about energisation of the electrically energisable device, wherein the signalling means includes a contact element which is a rolling element for contacting a key upon insertion of the key into the key-receiving member, the key-receiving member has means for guiding the contact element for reciprocation in a direction transverse to the direction of movement of the key during insertion of the key into the key-receiving member, the contact element is movable relative to the key-receiving member to follow formations on the key, the signalling means further comprises detector means and a lever for amplifying the motion of the contact element and applying the amplified motion to the detector means, the detector means comprises an emittor/detector pair for emitting and detecting radiant energy and a blocking element on one end of the said lever for interrupting selectively radiation of energy from the emittor to the detector, wherein said lever is pivotally mounted in the housing, wherein the lever has at end thereof remote from the blocking element a follower for following movement of the contact element, wherein the follower lies in the key-receiving member and partly in the housing when the key is absent and wherein the signalling means includes a microprocessor and means for feeding to the microprocessor signals provided by the detector means.

19. A device or lock according to claim 1 comprising biasing means acting on said obstructing element and means for holding the obstructing element against the action of the biasing means in a position to which the obstructing element has been set.

20. A method of controlling movement of a member relative to a body wherein an obstructing element disposed in an opening defined by the member moves with the member relative to the body, the member moves relative to the body from a first position in which the obstructing element is held by the body in said opening to a second position in which the opening defined by the member is aligned with an opening defined by the body, the obstructing element moves partly into the opening defined by the body and so obstructs reversal of said movement of the member, the obstructing element is subsequently driven by electrically energisable driving means out of the opening defined by the body into the opening defined by the member and said movement of the member relative to the body is then reversed.

21. A security device according to claim 6 wherein the control means comprises signalling means responsive to insertion of an unacceptable key into the key-receiving member to provide a locking signal which brings about energisation of the electrically energisable device to establish a secure condition of the security device.

22. A lock according to claim 8 comprising a locking element arranged to lock the key-receiving member against turning, in the absence of the key, and which is arranged to be moved by a leading end portion of the key, when the key is applied to the lock, to a releasing position in which the locking element permits turning of the key-receiving member and wherein the arrangement is such that said leading end portion of the key is required to move past the transmitting means before reaching the locking element.

* * * * *